United States Patent [19]

Illemann et al.

[11] 3,968,033

[45] July 6, 1976

[54] CLAMPING DEVICE FOR SCREEN BOTTOMS

[75] Inventors: Heinrich Illemann, St. Magdelen near Villach; Josef Urbanek, Steindorf, both of Austria

[73] Assignee: Osterreichisch-Amerikanische Magnesit Aktiengesellschaft, Carinthia, Austria

[22] Filed: Feb. 21, 1975

[21] Appl. No.: 551,544

[30] Foreign Application Priority Data

Feb. 25, 1974 Austria ..... 1493/74

[52] U.S. Cl. ..... 209/403; 209/319; 101/415.1

[51] Int. Cl.[2] ..... B07B 1/48

[58] Field of Search ..... 209/319, 403, 405, 408; 101/127.1, 128.1, 415.1; 160/380

[56] References Cited

UNITED STATES PATENTS

| | | | |
|---|---|---|---|
| 2,279,042 | 4/1942 | Harrington | 209/403 |
| 3,149,565 | 9/1964 | Norlin | 101/415.1 |
| 3,176,843 | 4/1965 | Hoskins | 209/403 |
| 3,695,757 | 10/1972 | Gregory | 101/378 X |

FOREIGN PATENTS OR APPLICATIONS

| | | | |
|---|---|---|---|
| 883,576 | 3/1943 | France | 160/380 |
| 1,133,224 | 7/1962 | Germany | 209/403 |
| 1,153,971 | 9/1973 | Germany | 209/403 |

*Primary Examiner*—Robert Halper
*Attorney, Agent, or Firm*—Everett H. Murray, Jr.

[57] ABSTRACT

A clamping device adapted to tighten a screen bottom onto a screen frame in a screening apparatus. The clamping device is provided with means disposed on one side of the screen frame for pneumatically tightening one side of the screen bottom to that side of the screen frame, the opposite side of the screen bottom being attached to the opposite side of the screen frame. The pneumatic tightening means is provided with a flexible inflatable hose and a compressed air source connected to the hose for inflating and deflating the hose.

8 Claims, 6 Drawing Figures

CLAMPING DEVICE FOR SCREEN BOTTOMS

BACKGROUND OF THE INVENTION

This invention relates to a clamping device for screen bottoms fastened to one long side of a screen frame and tightened on its other long side by means of this clamping device.

Up to the present, screen bottoms are generally stretched across appropriate frames, the so-called screen frames, by means of a toggle joint system presenting a spring as the tightening element and forming a part of the screen frame. When such a clamping device is applied, the respective screen bottom is stretched over a tightening angle by the tightening element which is disposed on one long side of the screen frame on whose other long side the screen bottom is fastened, usually over a tightening edge. The screen frames are of an angle iron construction, whereby one part of the frame, namely the part presenting the tightening element, can be raised. It is through this spring design of this part that the screen bottoms can be tightened by depressing the raisable part of the frame.

The result of the screening of materials through the screen bottoms is very severe wear so that only relatively short periods of screen bottom use can be obtained. This means that the screen bottoms must be replaced frequently. In order to replace these screen bottoms, it is absolutely necessary to dismount the heavy screen frames which may have a weight of about 65 kg. Numerous locking and sealing strips must be disassembled, and the screen frames must be lifted out of the screening machine to be recovered individually. Consequently, a screen change requires much time thereby reducing the production capacity of the screening machine and increasing its maintenance costs considerably.

Because not all of the screen bottoms of a screening machine wear uniformly and therefore do not wear out at the same time, and because a replacement of individual screen bottoms is possible only by dismounting other screen frames, it is generally preferred to repair the worn screens as long as possible by soldering on mesh patches. If one of the screens must finally be replaced, the decision is usually made to replace all the other screens of the screen set of this screening machine at the same time, even though they could still be used for some time. This is done in order to avoid replacing another screen within a short period of time.

The time required to replace a complete set of screens, for example, seven screen bottoms, is approximately 32 hours when the hitherto customary clamping devices are used. This time loss is considerable, and the production loss connected with it weighs heavily. Furthermore, exchanging the screen frames with such clamping devices takes at least four men because the heavy screen frames cannot otherwise be lifted out of the screening machine.

Accordingly, it is an object of this invention to provide a clamping device for screen bottoms making it possible to simplify and shorten the hitherto necessary procedure for screen changing that is very complicated and requires much effort and time. It has been found that this can be accomplished by using a pneumatic clamping device of a certain type.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the purpose of the invention, as embodied and broadly described herein, the clamping device of this invention, in a screen apparatus having a screen bottom for engagement with a screen frame, comprises a means for pneumatically tightening the screen bottom to the screen frame, the pneumatic means being disposed on one long side of the screen frame for tightening one long side of the screen bottom to that long side of the frame, the opposite long side of the screen bottom being attached to the opposite long side of the frame.

BRIEF DESCRIPTION OF THE DRAWINGS

The invention consists in the novel parts, constructions, arrangements, combinations, and improvements shown and described. The accompanying drawings, which are incorporated in and constitute a part of this specification, illustrate one embodiment of the invention and, together with the description, serve to explain the principles of the invention.

DESCRIPTION OF THE PREFERRED EMBODIMENT

Figure 1:
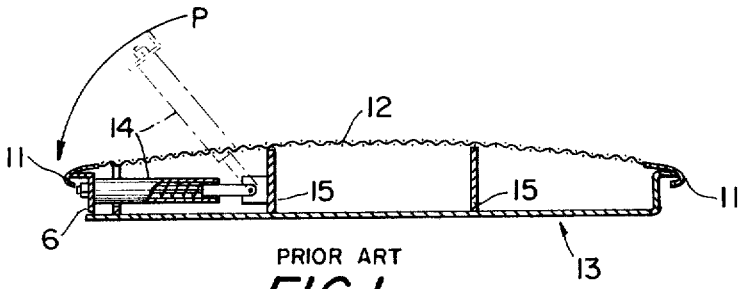
PRIOR ART FIG. 1
FIG. 1 shows diagrammatically, in section, an embodiment of a conventional clamping device.

Reference will now be made in detail to the present preferred embodiment of the invention, an example of which is illustrated in the accompanying drawings.

In FIGS. 1 to 4, the screen frame is designated as 13 in its entirety. Trusses 15 or the like are provided in this frame 13 for additional support of the screen bottom 12. Both long sides of the screen bottom 12 are equipped with tightening edges 11. On one side, the tightening edge engages a bent projection fixed to the frame 13 while the tightening edge 11 of the screen bottom 12 engages on the other long side a tightening angle 6 arranged so as to be movable relative to the frame 13 and forming part of the clamping device.

Figure 2:
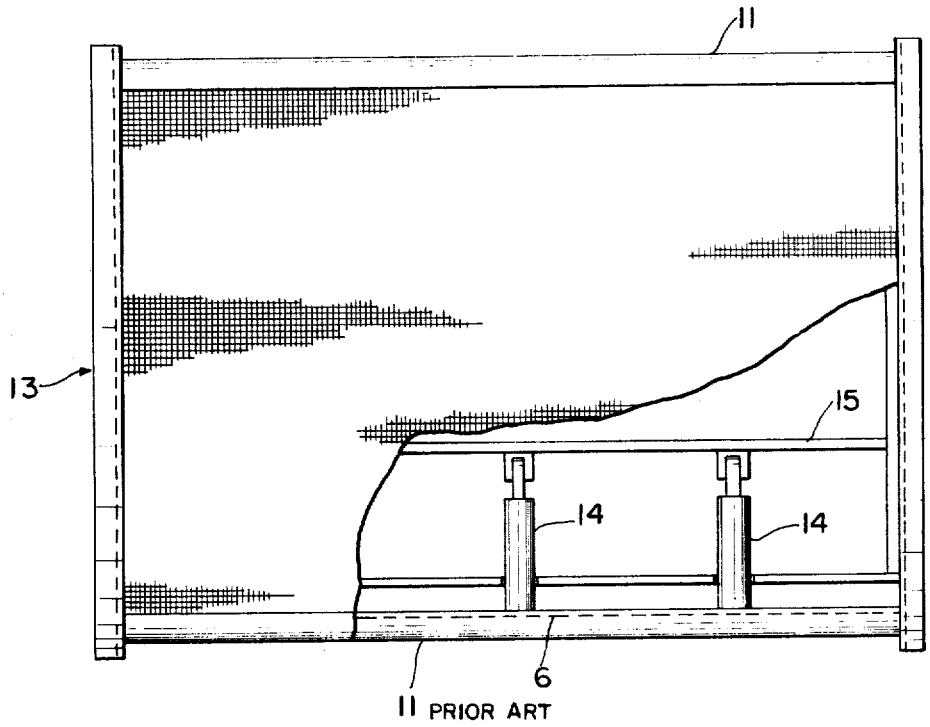
PRIOR ART FIG. 2
FIG. 2 is the top view of the device of FIG. 1, the screen being partly omitted.
Figure 3:
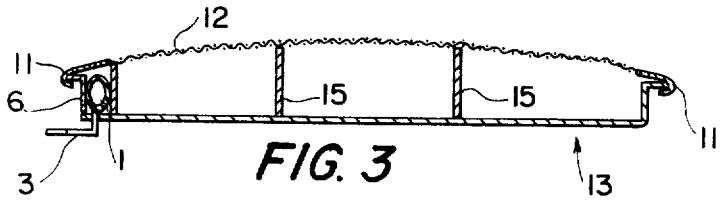
FIG. 3 shows diagrammatically, in section, a screening device equipped with a clamping device according to the invention.
Figure 4:
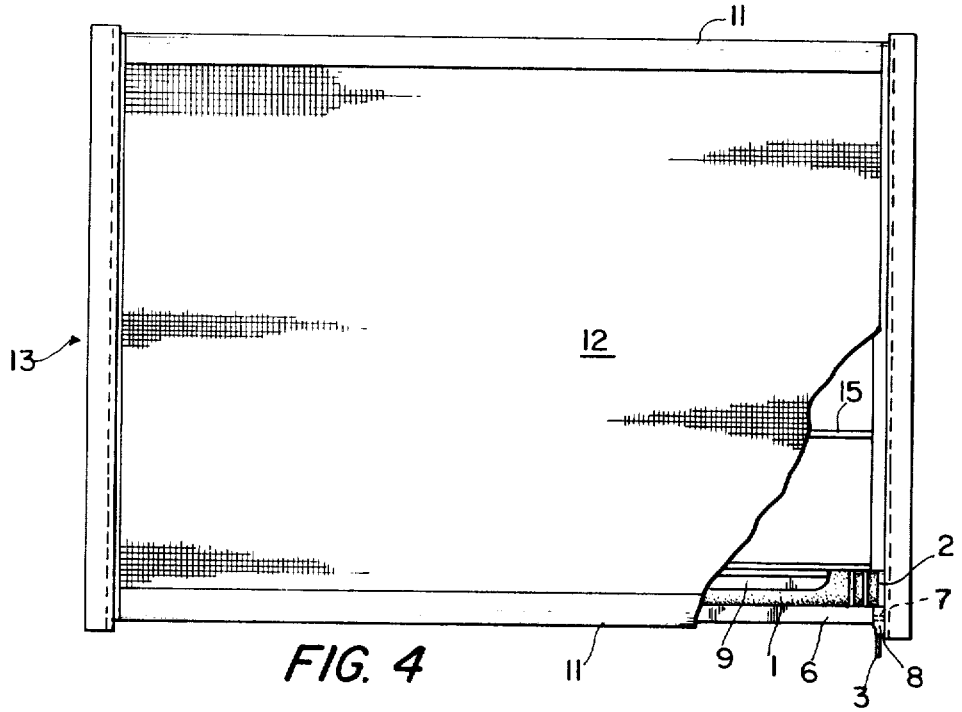
FIG. 4 is the top view of the device of FIG. 3, the screen being partly omitted.

In the design of a conventional clamping device shown in FIGS. 1 and 2, the tightening elements 14, which are elastic in their longitudinal direction, serve to fix the screen bottom 12. These tightening elements 14 are hinged to a bracket mounted to the frame, and they jointly support the movable tightening angle 6. To clamp the screen bottom to the frame it is necessary to first raise the tightening elements 14, including the tightening angle 6, hang the tightening edges 11 of the screen bottom 12 into the fixed tightening edge and the movable tightening angle 6, and then push it down, as indicated by the curved arrow P in FIG. 1.

In the preferred embodiment of the clamping device of this invention, as shown in FIGS. 3 through 6, an elastic hose 1 or flexible tubular member of rubber or another suitable material is loosely inserted along one long side of the screen frame 13. One side of this hose 1 supports itself in inflated condition against the frame. At the other side of hose 1, the movable clamping member, such as tightening angle 6, is disposed which is pushed into the tightening edge 11 of the screen bottom 12, tightening it when the hose 1 is inflated.

The tightening angle 6 covers the height of the hose 1 and is retained in the frame so as to be movable crosswise. Its retention in the frame 13 may be such as to allow a sliding motion of the tightening angle, or a pivoting motion, or even a combination of the two mobility possibilities.

As a result of the general design of the clamping device according to this invention, the tightening components do not have to be raised, and the frames no longer need to be dismounted in order to install a new screen bottom. Rather, the screen bottom can be replaced relatively quickly. The same applies also to disassembly.

Figure 5:
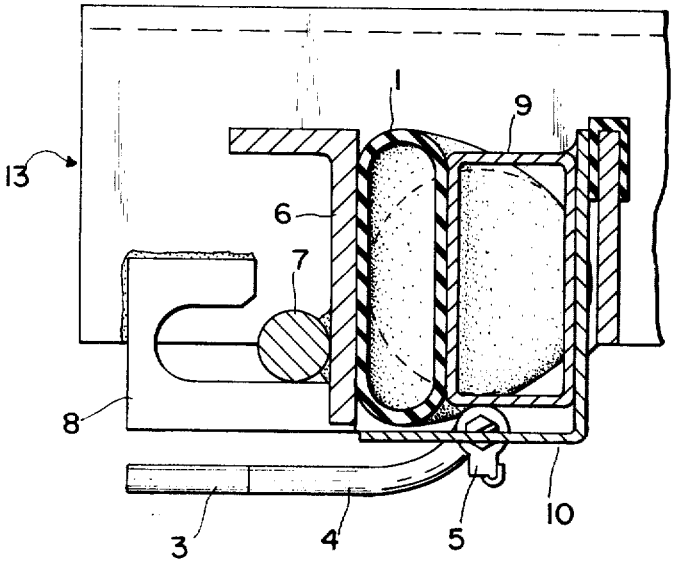
FIG. 5 is an embodiment of the clamping device according to the invention in detail section.

FIG. 5 shows a preferred embodiment of the clamping device and the retention means for retaining the tightening angle 6. At both lateral cheeks of the screen frame 13 there are mounted, such as by welding, at a suitable level, guide pieces 8 presenting an elongated slot for the retention of a pin 7, each of which is mounted on the end of the tightening angle 6 and projects beyond it. At the end of guide 8 facing the hose 1, elongated slot of guide 8 is open on top in order to insert the tightening angle 6 with its projecting pins 7. This mode of retention provides in a simple manner a combination pivot and slide mounting for the tightening angle 6. It is noted that other types of retention means could be employed. However, it is believed that those of the preferred embodiment provide a simple, inexpensive and efficient method for retaining the tightening angle 6.

Figure 6:
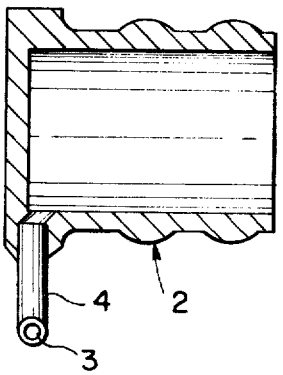
FIG. 6 shows an end closure for the clamping hose with a compressed air supply line connected to it.

FIG. 5 also shows an advantageous support of hose 1 against the frame beam. It consists of a hollow box section 9 which, as most clearly shown in FIG. 4, does not extend over the entire length of frame 13. The termination of hollow box section 9 at points spaced from the sides of frame 13, creates, at both ends, niches to facilitate the accommodation of the end plugs 2, as illustrated in FIG. 6, for the hose. The ends of the hollow box section 9 are appropriately rounded so as to provide a transition and prevent damage to the hose.

Preferably, hollow end plugs 2, one of which is shown in FIG. 6, may be used to close the ends of hose 1. Hollow end plug 2, at least at one end of the hose 1, is provided with a connection 4 for the compressed air supply line. This connection may be provided, as shown by way of example, in the end flange portion of plug 2. The connection 4 may be equipped with a shut-off valve 3. It is also possible, particularly for heavy duty machines, to supply and control all tightening devices of a machine with compressed air through an inflexible installation to assure optimum reliability. All that is then necessary for replacement is to detach quick-disconnects.

It is also preferred, as shown in FIG. 6, that end plug 2 be provided with a corrugated outside surface to ensure a tight seal when inserted in the end of hose 1.

To further ensure the seal between the end plug 2 and the hose 1, a hose clamp 5 is provided, as seen in FIG. 5, which will tighten and hold hose 5 in place on end plug 2.

In the preferred embodiment shown in FIG. 5, the hose 1 with its plugs 2 and the hollow box section 9 are mounted to a means, such as angle section 10, detachably mounted to the screen frame 13. This detachable fastening may consist of a saddle suspension, as shown by way of example.

Such a clamping device is readily exchangeable and can be retrofitted to existing screening machines to replace the conventional clamping devices by making some easy changes.

If required, the clamping device of this invention may also be disposed on both long sides of the screening frame 13, for instance, in cases where the screen bottoms have to be stretched over a long given distance.

In accordance with the invention, the tightening operation using the clamping device is accomplished in the following manner. After the screen bottom 12 is hung into the fixed tightening angle on the other side of the screen frame 13, the hose 1 is compressed by means of the tightening angle 6 which is guided in the frame 13 so as to be movable crosswise, and the tightening edge 11 of the screen bottom 12 is loosely engaged on the tightening angle 6 in the general position shown in FIG. 3. Then the tightening angle 6 is pushed outwardly by inflating the hose 1, thereby tightening the screen bottom to the desired extent. As the screen is tightened by expansion of hose 1, pin 7, mounted on tightening angle 6, enters the slot in guide 8 to hold tightening angle 6 in a fixed position of relationship with frame 13 until hose 1 is deflated. As explained earlier, changing screens using the present invention can easily be accomplished by a single operator, and the screen frame no longer needs to be dismounted for this purpose.

A comparison of the conventional clamping device, as shown in FIGS. 1 and 2, with the clamping device according to the invention, as shown in FIGS. 3 to 6, clearly indicates that the clamping device occupies considerably less space than the conventional one and requires no space within the working area of the screen.

It will be apparent to those skilled in the art that various modifications and variations could be made in the clamping device of the invention without departing from the scope or spirit of the invention.

What is claimed is:

1. A screening apparatus comprising:

a. a screen frame having first and second opposed sides;

b. a screen bottom for positioning on said screen frame, wherein said screen bottom has first and second opposed sides corresponding to said first and second opposed sides of said screen frame, said first opposed side of said screen bottom being detachable and attachable to said first opposed side of said screen frame;

c. a fluid pressure source; and d. means for pneumatically tightening said screen frame, said tightening means being disposed below said screen bottom and horizontally adjacent said second opposed side of said screen frame for tightening said second opposed side of said screen bottom to said second opposed side of said screen frame, and wherein said tightening means includes:

i. a deflatable and inflatable tubular member running substantially the length of said second opposed side of said screen frame, and operatively connected to said fluid pressure source; and ii. a detached clamping member movably mounted on said screen frame and running horizontally along the length of one side of said tubular member between said tubular member and said second opposed side of said screen bottom, said clamping member being movable by inflation of said tubular member for engagement with said second opposed side of said screen bottom.

2. The screening apparatus recited in claim 1, wherein said clamping member is releasably positioned on said second opposed side of said screen frame and has a height substantially equal to that of said tubular member, and wherein said screen frame further includes means for retaining said clamping member in fixed relationship to said screen frame when said tubular member is inflated.

3. The screening apparatus recited in claim 2 wherein said clamping member has pins projecting from its ends and said retaining means includes spaced guide pieces having elongated slots for engaging said pins of said clamping member.

4. The screening apparatus recited in claim 1, wherein said tightening means includes a pair of plugs for closing the ends of said tubular member, and wherein said screen frame includes a hollow rectangular section on one side of said tubular member, said tubular member thereby being positioned between said hollow rectangular section and said clamping member, and said rectangular section having niches at its ends for accommodating said plugs.

5. The screening apparatus recited in claim 1, wherein said tightening means includes means detachably mounted on said screen frame running along the length of the other side of said tubular member from said clamping member for positioning and supporting said tubular member along said second opposed side of said screen frame.

6. The screening apparatus recited in claim 1, wherein said tightening means includes plugs for closing the ends of said tubular member, a line for providing fluid communication between said fluid pressure source and one of said plugs, and a valve positioned in said line for regulating fluid pressure from said fluid souce to said one of said plugs.

7. A screening apparatus comprising:

a. a series of screen frames having first and second opposed sides;

b. a corresponding series of screen bottoms for positioning on said screen frames, wherein said screen bottoms have first and second opposed sides corresponding to said first second opposed sides of said screen frames, said first opposed side of said screen bottoms being detachable and attachable to said first opposed side of said screen frames;

c. a fluid pressure source; and d. means for each of said corresponding screen bottoms and screen frames for pneumatically tightening said screen bottom to said screen frame, said tightening means being disposed below said screen bottom and horizontally adjacent said second opposed side of said screen frame for tightening said second opposed side of said screen bottom to said second opposed side of said screen frame, and wherein said tightening means includes:

i. a deflatable and inflatable tubular member running substantially the length of said second opposed side of said screen frame and wherein each of said tubular members is connected to said fluid pressure source and capable of being operated jointly with each other; and ii. a detached clamping member movably mounted on said screen frame and running horizontally along the length of one side of said tubular member between said tubular member and said second opposed side of said screen bottom, said clamping member being movable by inflation of said tubular member for engagement with said second opposed side of said screen bottom.

8. A screening apparatus comprising:

a. a screen frame;

b. a screen bottom that engages said screen frame;

c. clamping means for pneumatically tightening one long side of said screen bottom to one long side of said screen frame, the opposite long side of said screen bottom being attached to the opposite long side of said screen frame, said clamping means including:

i. a flexible inflatable hose disposed on said one long side of said screen frame;

ii. a fluid pressure source connected to said hose for deflating and inflating said hose;

iii. a pair of plugs for closing the ends of said hose; and iv. a member movably mounted on said screen frame and releasably positioned against said one long side of said screen bottom for tightening said screen bottom to said screen frame when said hose is inflated; and wherein said screen frame includes a hollow rectangular section positioned adjacent said hose, said hose being disposed between said hollow rectangular section and said member; and wherein said hollow rectangular section has niches at its ends for accommodating said plugs.

* * * * *